US007010813B2

(12) United States Patent
Ahn et al.

(10) Patent No.: US 7,010,813 B2
(45) Date of Patent: Mar. 14, 2006

(54) LEISURE SPORTS HELMET

(76) Inventors: Dong Sok Ahn, C-403, Chungwon APT., 80-4 Anyang-2Dong, Manan-Gu, Anyang-City, Kyounggi-Do (KR); Byung Gi Rho, 651-1, Hogae-dong, Donggan-gu, Anyang-city, Kyounggi-Do (KR)

( * ) Notice: Subject to any disclaimer, the term of this patent is extended or adjusted under 35 U.S.C. 154(b) by 0 days.

(21) Appl. No.: 10/790,463

(22) Filed: Mar. 2, 2004

(65) Prior Publication Data

US 2005/0108807 A1 May 26, 2005

(30) Foreign Application Priority Data

Nov. 20, 2003 (KR) ..... 10-2003-0082516

(51) Int. Cl.
*A42C 5/04* (2006.01)

(52) U.S. Cl. ..... 2/171.3; 2/412; 2/425; 2/906

(58) Field of Classification Search ..... 2/906, 2/411, 412, 424, 425, 414, 410, 7, 436, 422, 2/437, 209.13, 171.3; 128/201.15, 201.24, 128/201.25, 200.28, 201.23
See application file for complete search history.

(56) References Cited

U.S. PATENT DOCUMENTS

| | | | | |
|---|---|---|---|---|
| 1,774,074 A | * | 8/1930 | Wittcoff | 2/171.7 |
| 3,168,748 A | * | 2/1965 | Limberg | 2/171.3 |
| 3,735,423 A | * | 5/1973 | Droz | 2/171.3 |
| 4,434,514 A | * | 3/1984 | Sundahl et al. | 2/425 |
| 4,634,343 A | * | 1/1987 | Nakamats | 416/3 |
| RE33,286 E | * | 8/1990 | Waters | 2/171.3 |
| 5,337,421 A | * | 8/1994 | Jeng | 2/425 |
| 5,426,792 A | * | 6/1995 | Murasko | 2/422 |
| 5,544,027 A | * | 8/1996 | Orsano | 362/105 |
| 5,687,426 A | * | 11/1997 | Sperber | 2/411 |
| 6,017,049 A | * | 1/2000 | Spector | 280/288.4 |
| 6,081,929 A | * | 7/2000 | Rothrock et al. | 2/171.3 |
| 6,122,773 A | * | 9/2000 | Katz | 2/171.3 |
| 6,732,381 B1 | * | 5/2004 | Lal | 2/425 |

FOREIGN PATENT DOCUMENTS

| | | | |
|---|---|---|---|
| JP | 10096116 A | * | 4/1998 |
| JP | 2001172816 A | * | 6/2001 |
| JP | 2004068237 A | * | 3/2004 |

* cited by examiner

*Primary Examiner*—Rodney M. Lindsey
(74) *Attorney, Agent, or Firm*—Park Law Firm; John K. Park

(57) ABSTRACT

The object of this invention is to provide a leisure sports helmet having both a fan and a plurality of vents on a helmet body. Due to the fan (100) and the vents (20), atmospheric air is drawn into the interior of the helmet to cause convection to transfer heat from the head of a user to the air, and the heated air with sweat is discharged to the atmosphere. Thus, the helmet is forcibly ventilated while the user wearing the helmet participates in rapid leisure sports, so that the helmet does not generate any odor caused by the heat and sweat in the interior of the helmet and maintains a pleasant and comfortable atmosphere. The fan collaterally provides a decoration effect to make the appearance of the helmet more attractive.

12 Claims, 6 Drawing Sheets

LEISURE SPORTS HELMET

CLAIMING FOREIGN PRIORITY

The applicant claims and requests a foreign priority, through the Paris Convention for the Protection of Industry Property, based on a patent application filed in the Republic of Korea (South Korea) with the filing date of Nov. 20, 2003, with the patent application Ser. No. 10-2003-0082516, by the applicant.

BACKGROUND OF THE INVENTION

The present invention relates, in general, to leisure sports helmets which are protective head coverings worn by users while the users participate m rapid leisure sports, such as cycling, inline skating, skate boarding, etc., to protect the users' heads and, more particularly, to a leisure sports helmet which maintains a fresher atmosphere in the interior thereof to give an agreeable and comfortable fitness to the users, as well as provides an attractive appearance.

Generally, various types of leisure sports helmets have been proposed and used. The leisure sports helmets are protective head coverings worn by users while the users participate in rapid leisure sports, such as cycling, inline skating, skate boarding, etc. Thus, the helmets absorb any impacts applied to the users' heads and disperse the force of the impact to protect the users' heads when there occur unexpected safety accidents, such as falling or collisions with hard materials, during participating in the rapid leisure sports. The helmets thus protect the user's heads or minimize injuries to the users' heads in the case of safety accidents.

Conventional leisure sports helmets comprise a rounded, rigid outer shell shaped to correspond to the general shape of the head of a user, and a soft inner shell placed in the outer shell to cover the user's head The rigid outer shell is produced through an injection molding process using a synthetic resin material with higher strength and higher rigidity to effectively reduce impacts, while the soft inner shell is made of a foaming resin material or another material with higher impact absorbing and impact force dispersing abilities.

However, since the inner shells of the conventional leisure sports helmets are constructed to be in close contact with the users' heads without leaving any effective space between the users' heads and the inner shells, the conventional leisure sports helmets do not well ventilate the spaces between the users' heads and the inner shells, thus having a poor ventilation effect.

Due to the poor ventilation of the spaces between the users' heads and the inner shells, the conventional leisure sports helmets cannot effectively circulate air which would remove sweat and heat from the users' heads. Thus, the conventional leisure sports helmets undesirably retain heat which leads to sweat that generates an odor, and fail to provide an agreeable or comfortable fitness to the users, but may cause problems in the health of the users, particularly, damage to the skin and hair of the head.

To solve the above-mentioned problems, some helmet manufacturers proposed leisure sports helmets with a plurality of vents formed at predetermined positions of each of the helmets to provide a ventilation effect In the conventional leisure sports helmets with the vents, atmospheric air accesses the spaces between the users' heads and the inner shells through the vents to remove heat and odor from the heads. However, the conventional leisure sports helmets with the vents do not achieve a desired level of ventilation effect. In a detailed description, the conventional leisure sports helmets with the vents are constructed to cause a difference in the air pressure between the inside and outside of the helmet due to rapid air currents flowing around the external surface of the outer shell of the helmet, so that the conventional leisure sports helmets with the vents circulate air from the interior of the helmet to the atmosphere through the vents to remove heat and sweat, and thus, odor from the users' heads. However, the conventional leisure sports helmets with the vents have structural and functional defects in that the helmets fail to effectively circulate air which would remove heat and sweat from the user's head covered with the inner shell. Furthermore, the conventional leisure sports helmets have only dull or poor appearance to reduce the market competitiveness of the helmets.

SUMMARY OF THE INVENTION

Accordingly, it is an sect of the present invention to provide a leisure sports helmet which introduces fresh atmospheric air into the helmet while a user of the helmet participates in rapid leisure sports, thus causing convection to transfer the heat from the head of the user to the fresh air, and forcibly discharging the heated air with sweat to the atmosphere, thus achieving a desired level of ventilation effect to almost completely remove any heat and sweat, and thus, odor from the head of the user.

It is another aspect of the present invention to provide a leisure sports helmet which maintains a comfortable and pleasant atmosphere in the interior of the helmet, thus effectively removing any heat and sweat, and thus, odor from the head of the user and thereby protecting the skin and hair of the user's head from damage.

It is a further aspect of the present invention to provide a leisure sports helmet which has a plurality of vents at predetermined positions thereof; with air channels to allow for communication between the vents, and which thus forces fresh atmospheric air to flow from the vents to all sections of the user's head covered with the helmet and causes convection to transfer the heat from the user's head to the flesh air in the helmet, and which forcibly discharges the heated air with sweat to the atmosphere, due to a circulation force produced by a fan that is installed at a predetermined position of the helmet to rotate by a power generating unit, such as a motor, or air currents, thus cooling the user's head, and which provides an active appearance by changing the location and/or shape of the fan.

Additional aspects and/or advantages of the invention will be set forth in part in the description which follows and, in part, will be obvious from the description, or may be learned by practice of the invention.

The above and/or other aspects are achieved by providing a leisure sports helmet, comprising: a helmet body comprising: a rounded outer shell shaped to correspond to a shape of a head of a user and having a strength and rigidity higher than predetermined levels to reduce impacts and disperse a force of the impacts; and an inner shell placed in the outer shell to cover the head of the user and having higher impact absorbing and impact force dispersing abilities; a plurality of vents formed through both the outer and inner shells at predetermined positions of the helmet body, thus introducing atmospheric air to an interior of the helmet body and discharging the air from the interior of the helmet body to the atmosphere along with heat generated from the head of the user, and a fan provided at a predetermined position of the helmet body to rotate by rapid air currents flowing around the helmet body, thus forcibly discharging the heated air from the interior of the helmet body to the atmosphere through the plurality of vents and decorating the helmet body.

In an aspect, the fan provided in the helmet body rotates while the user travels rapidly when participating in leisure sports, and thus heated air with sweat is forcibly discharged to the atmosphere by the fan while fresh atmospheric air is introduced into the interior of the helmet body to cause convection to transfer heat to the air in the interior of the helmet body. The interior of the helmet body is ventilated, and any odor caused by the heat and sweat is not generated in the helmet.

In another aspect the fan rotates to forcibly introduce the atmospheric air into the interior of the helmet body, and causes convection to transfer heat to the air in the interior of the helmet body, and, thereafter, the heated air with sweat is discharged to the atmosphere through the vents, thus ventilating the interior of the helmet body to remove heat and sweat, and thereby, odor from the head of the user.

The fan of the present invention may be operated by a power generating unit or by rapid air currents which flow around the helmet when the user participates in rapid leisure sports.

BRIEF DESCRIPTION OF THE DRAWINGS

Description of the Drawings

Figure 1:
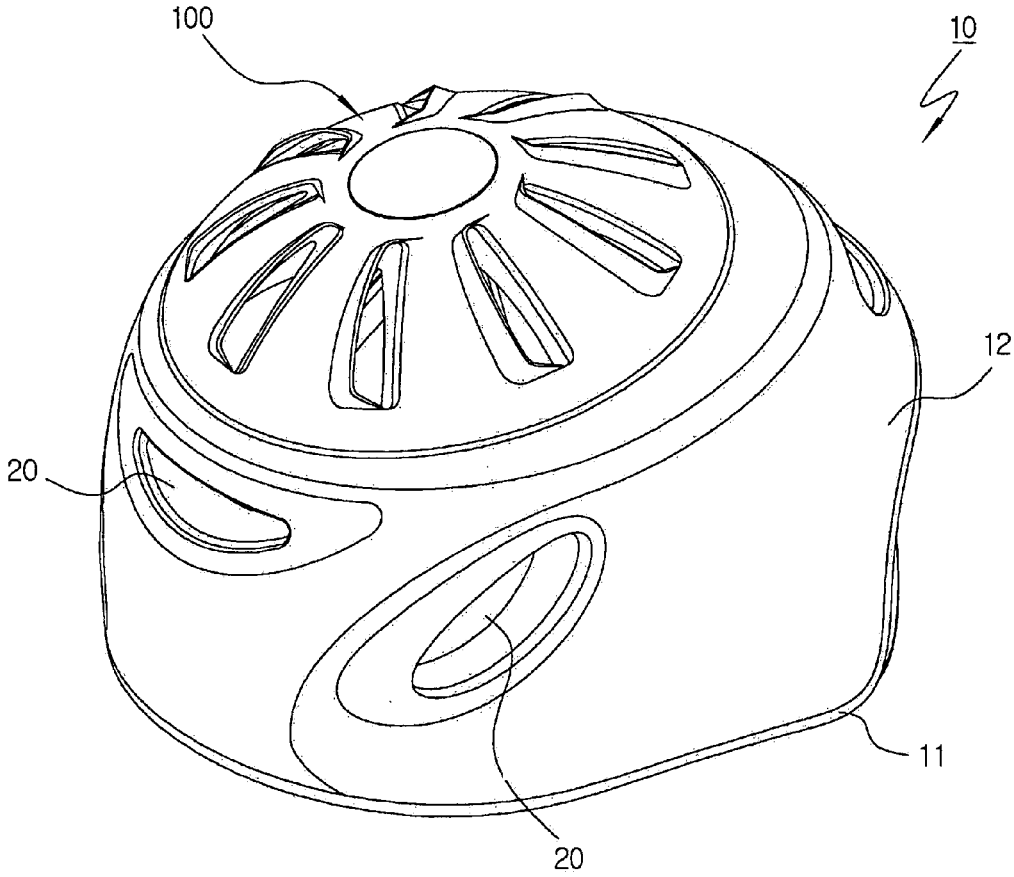
Figure 2:
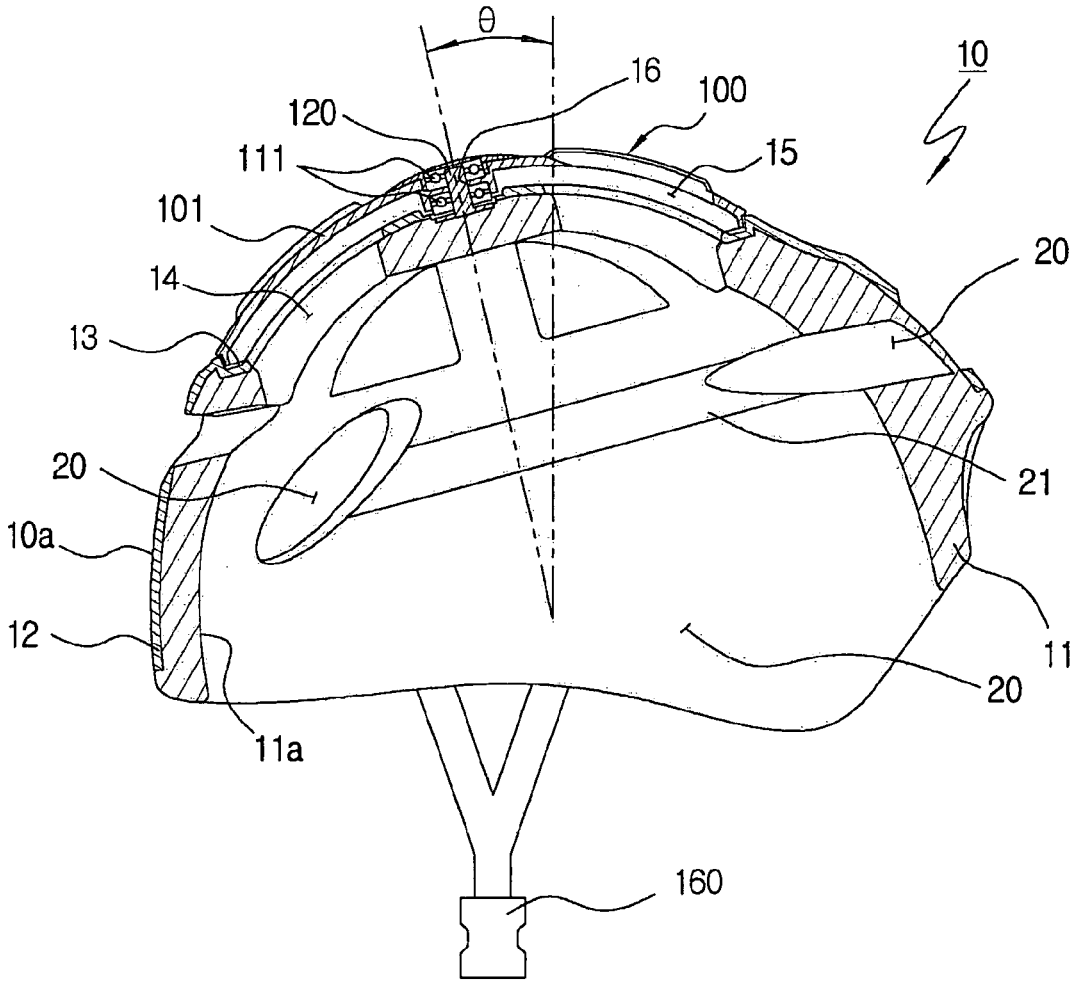
Figure 3:
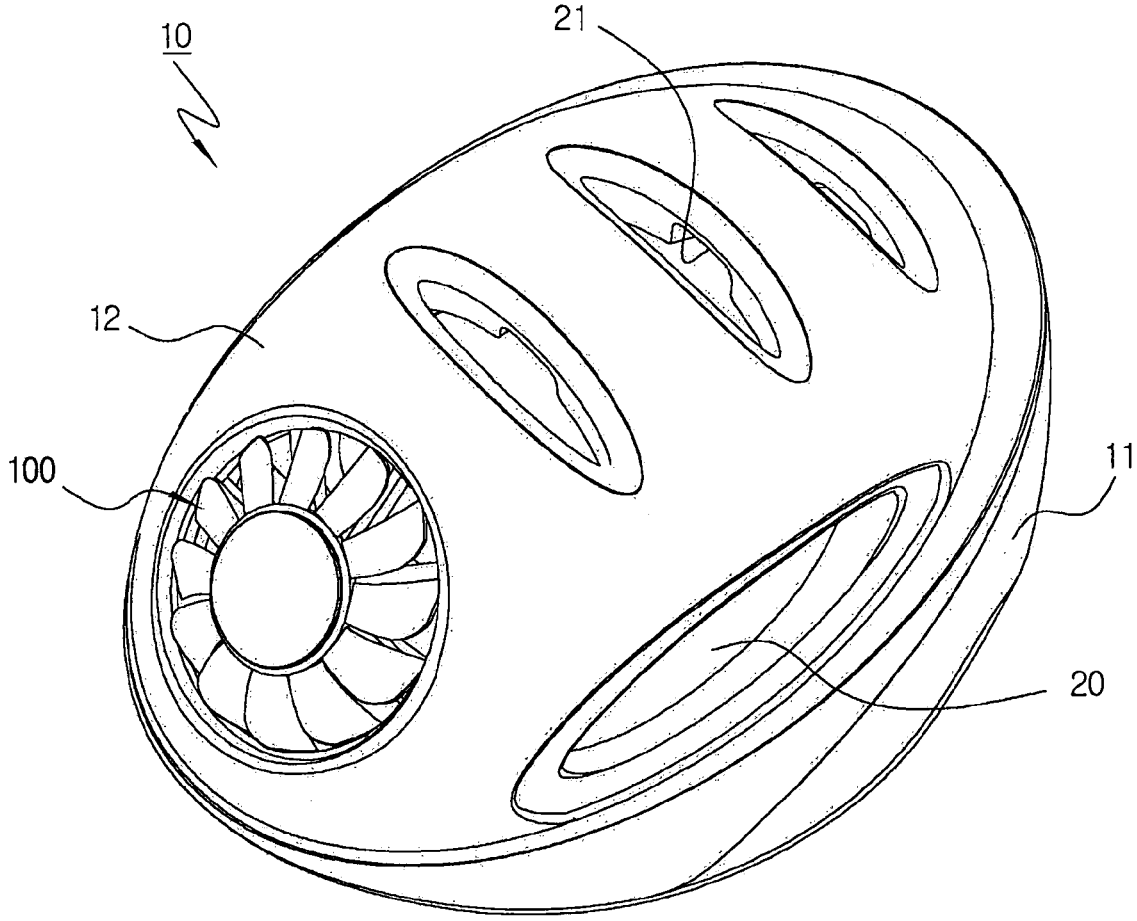
Figure 4:
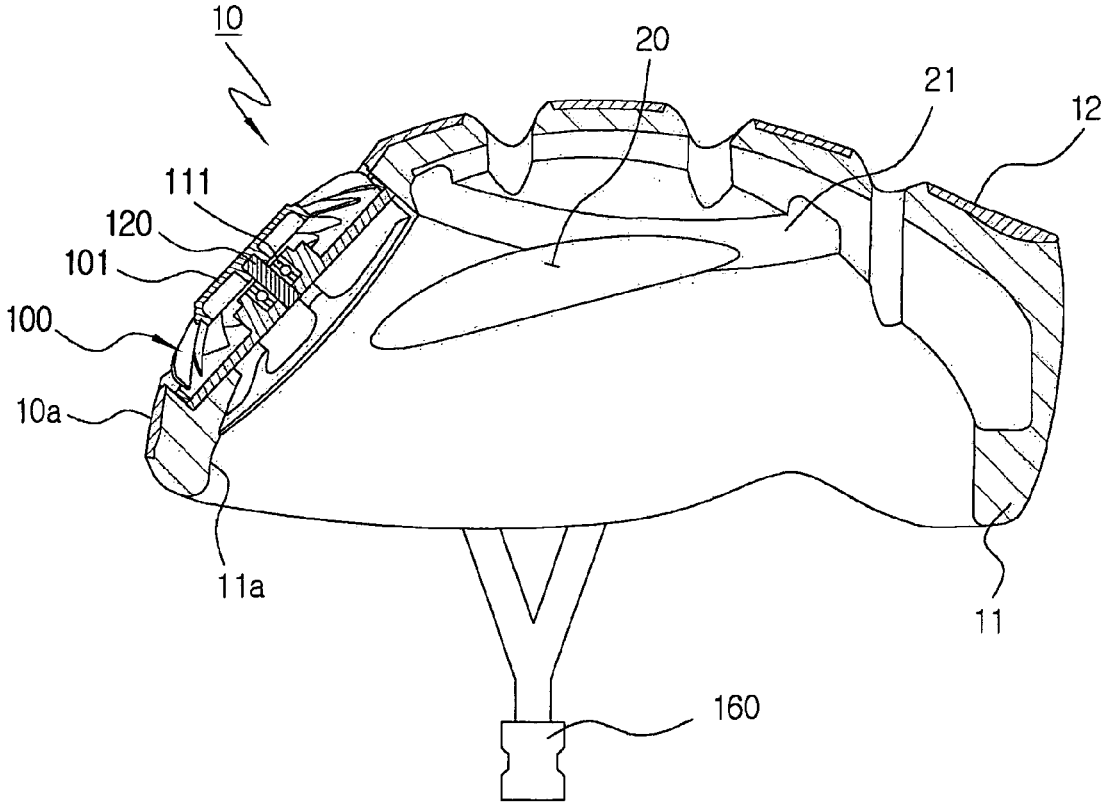
Figure 5:
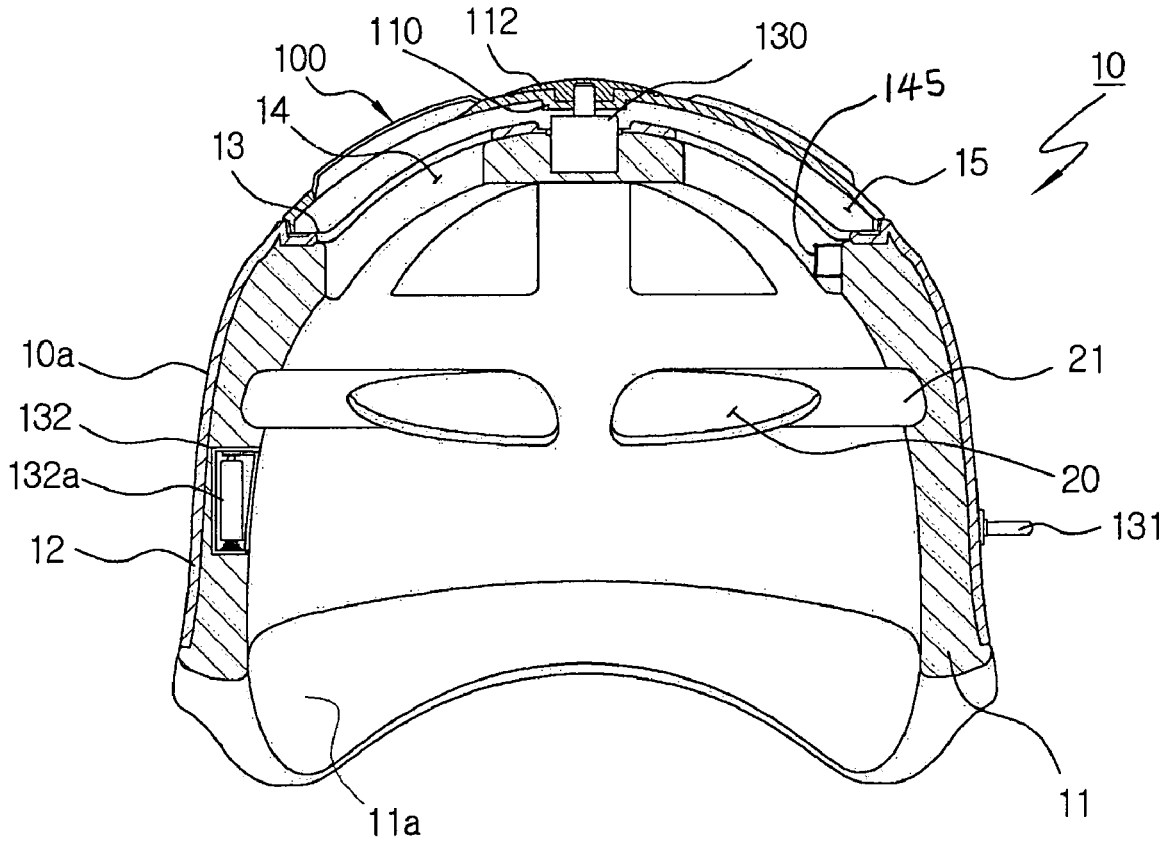
Figure 6:
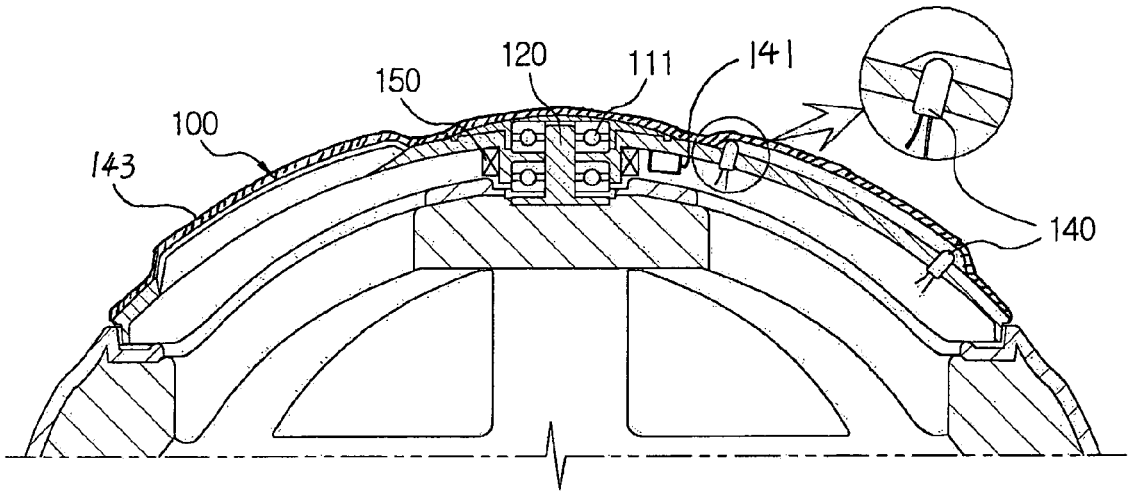

The above and other objects, features and other advantages of the present invention will be more clearly understood from the following detailed description taken in conjunction with the accompanying drawings, in which:

FIG. 1 is a perspective view of a leisure sports helmet according to a first embodiment of the present invention;

FIG. 2 is a sectional view showing the construction of the leisure sports helmet of FIG. 1;

FIG. 3 is a perspective view of a leisure sports helmet according to a second embodiment of the present invention;

FIG. 4 is a sectional view showing the construction of the leisure sports helmet of FIG. 3;

FIG. 5 is a sectional view of a leisure sports helmet according to a third embodiment of the present invention; and FIG. 6 is an enlarged sectional view of a leisure sports helmet according to a fourth embodiment of the present invention.

DETAILED DESCRIPTION OF THE INVENTION

Reference should now be made to the drawings, in which the same reference numerals are used throughout the different drawings to designate the same or similar components.

FIGS. 1 through 6 show the construction of leisure sports helmets according to first to fourth embodiments of the present invention.

The leisure sports helmet of the present invention protects the head of a user from safety accidents while the user participates in rapid leisure sports, and forcibly circulates air which removes any heat and sweat, and thus, odor from the head of the user, thereby maintaining a freer atmosphere in the interior of the helmet to give an agreeable and comfortable fitness to the users. To achieve the above-mentioned object, the helmet of the present invention is provided at a predetermined position thereof with a fan that rotates by a power generating unit, such as a motor, or air currents.

The leisure sports helmet of the present invention comprises a rounded helmet body 10 with an inner shell 11 and an outer shell 12. A fan 100 is provided at a predetermined position of the helmet body 10 to forcibly draw flesh atmospheric air into the interior of the helmet body 10 and to forcibly discharge heat from the interior of the helmet body 10 to the atmosphere. The leisure sports helmet of the present invention further comprises a plurality of vents 20 through which the air is drawn into and discharged from the interior of the helmet body 10.

The inner shell 11 is produced through a forming process using a foaming resin material or another material that is easily formed to a desired rounded shape corresponding to the shape of the head of a user and has higher impact absorbing and impact force dispersing abilities to protect the user's head from any impact. Preferred examples of the materials of the inner shell 11 are polyurethane foam and Styrofoam. The rounded shape of the helmet body 10 may be selected from hemispherical shapes and streamlined shapes, according to the use of the helmet Particularly, when the helmet body 10 has a streamlined shape, the helmet minimize the pneumatic resistance imposed on the external surface of the helmet by air currents while the user of the helmet travels rapidly when participating in rapid leisure sports.

Of course, the inner shell 11 of the helmet body 10 may be designed to have a variety of shapes to meet the requirements of the consumers of the helmets. Furthermore, the outer shell 12 of the helmet body 10 may be freely designed to have a variety of colors, patterns and shapes, and may be produced using a variety of materials. For example, the outer shell is preferably produced using polycarbonate or ABS copolymer (acrylonitrile butadiene styrene copolymer).

The plurality of vents 20, through which the air is drawn into and discharged from the interior of the helmet body 10, are formed through both the inner and outer shells 11 and 12 at predetermined positions of the back and both sides of the helmet body 10. In the present invention, the number of the vents 20 is two or more. The helmet body 10 further includes a plurality of air channels 21 which are provided on the inner surface 11*a* of the inner shell 11 to allow the vents 20 to communicate with each other, as well as with a plurality of ventilating openings 14 which will be described later herein. The air channels 21 are grooves to provide paths of the air between the vents 20 and the ventilating openings 14, so that the fresh atmospheric air from the vents 20 is evenly distributed to all sections of the head of the user. Thus, the helmet allows cool air to absorb heat from the head of the user wearing the helmet, and provides a desired level of ventilation effect.

The plurality of ventilating openings 14 are provided on the helmet body 10 at predetermined positions to introduce the atmospheric air into the interior of the helmet and to discharge the air to the atmosphere to remove any heat and sweat, and thus, odor from the interior of the helmet. The ventilating openings 14 are formed around a shaft hole 16 of the helmet body 10 in radial directions, with the fan 100 mounted to the shaft hole 16.

The fan 100 has a rotating shaft 120 that is fitted in the shaft hole 16, with a plurality of blades 101 mounted to the rotating shaft 120. Thus, the fan 100 rotates around the rotating shaft 120 to forcibly discharge the air to the atmosphere to remove any heat and sweat, and thus, odor from the interior of the helmet In a detailed description, the helmet body 10 is depressed at a predetermined portion of an upper part thereof to form a depression 13 that is lower than the external surface 10*a* of the helmet body 10. The shaft hole 16 is formed through the center of the depression 13, while the ventilating openings 14 are formed on the helmet body 10 at positions around the shaft hole 16 of the depression 13 in radial directions. The rotating shaft 120 of the fan 100 is mounted to the shaft hole 16, so that the fan 100 is installed in the depression 13 of the helmet body 10.

In the helmet of the present invention, the depression 13 provides a space 15 between the blades 101 of the fan 100 and the external surface 10*a* of the helmet body 10, so that the heated air with sweat is easily and smoothly discharged from the interior of the helmet body 10 to the atmosphere through the space 15. Thus, any odor caused by the heat and sweat is not generated in the interior of the helmet body 10.

A boss 110 protrudes at the center of the fan 100, with a bearing 111 set in the boss 110. The rotating shaft 120 is fitted in the boss 110 of the fan 100, and is mounted to the shaft hole 16 of the helmet body 10 to rotate in the shaft hole 16 while being supported by the bearing 111. In the above state, the fan 100 rotates by the rapid air currents flowing around the outer surface 10*a* of the helmet body 10, while the user wearing the helmet travels rapidly when participating in rapid leisure sports, such as cycling, inline skating or skate boarding. The fan 100 thus discharges the heated air with sweat from the interior of the helmet body 10 to the atmosphere, and thus, prevents odor from being generated in the helmet body 10.

The boss 110 of the fan 100 has a predetermined length, with at least one bearing 111 installed in the boss 110. The boss 110 of the fan 100 provides the space 15 around the fan 100 that is installed in the depression 13 of the helmet body 10.

As described above, the fan 100 having the bearing 111 preferably rotates by the rapid air currents flowing around the helmet body 10 while the user travels rapidly when participating in rapid leisure sports. However, the fan 100 may be constructed to rotate by a motor 130 that is a power generating unit. When the fan 100 is designed to be motor-operated, the motor 130 is coupled to the boss 110 of the fan 100. Furthermore, a battery chamber 132 is provided in a predetermined portion of the inner shell 11 of the helmet body 10 to install a battery 132*a* in the helmet body 10. A power switch 131 is provided at a predetermined position of the outer casing 12 of the helmet body 10 to protrude from the external surface 11*a* of the helmet body 10. Thus, the motor 130 is opted by an ON/OFF operation of the switch 131, thus rotating the fan 100.

To decorate the helmet of the present invention, a plurality of lamps 140 may be installed at predetermined positions of the helmet body 10 to be turned on or off by electricity which may be supplied from the battery 132*a* of the battery chamber 132 or generated by the rotation of the fan 100. Due to the light emitted from the lamps 140, the helmet provides a decoration effect to stimulate the curiosity of those around the user while the user participates in rapid leisure sports, and furthermore provides a visual alarming effect to attract the attention of those around the user, thus reducing the risk of safety hazards, such as collisions with people.

In a preferred embodiment of the present invention, the lamps 140 are turned on or off by electricity which is generated by a generator 150 during the rotation of the fan 100. In a detailed description, the generator 150 is provided around the boss of the fan 100 to generate electricity as a result of the rotation of the fan 100, and thus electricity is supplied to the lamps 140 to turn on or off the lamps 140. In the present invention, a variety of conventional lamps, such as LEDs (light emitting diodes), may be preferably used as lamps 140. In the drawings, the reference numeral 160 denotes a chinstrap of the helmet.

Herein below, the construction and operation of the preferred embodiments of the present invention will be described in detail.

FIGS. 1 and 2 are views of a leisure sports helmet according to the first embodiment of the present invention. In the first embodiment, the fan 100 is placed in a front part of the helmet body 10, so that the fan 100 freely rotates by the rapid air currents flowing around the helmet body 10 while a user of the helmet travels rapidly when participating in rapid leisure sports, such as cycling, inline skating or skate boarding. Thus, the fan 100 forcibly discharges heated air with sweat from the interior of the helmet to the atmosphere through the ventilating openings 14, while causing fresh atmospheric air to be forcibly drawn into the interior of the helmet through the vents 20. Therefore, the fan 100 prevents any odor caused by the heat and sweat from being generated in the interior of the helmet. In the first embodiment, the fan 100 according to the first embodiment acts as an exhaust fan.

In the leisure sports helmet according to the first embodiment of the present invention, the helmet body 10 comprises the inner shell 11 that is shaped to correspond to the shape of the head of the user and the outer shell 12 that surrounds the inner shell 11. The fan 100 is provided in the upper part of the external surface 10*a* of the helmet body 10 to be slightly leaned forward. A chinstrap 160 is attached to the helmet body 10 for passing under the chin of the user, so that the helmet body 10 is in close contact with the head of the user.

In the leisure sports helmet according to the first embodiment of the present invention, the fan 100 is installed at a predetermined position in the upper part of the helmet body 10 to be slightly leaned forward, thus being placed over the parietal region of the user's head. The above-mentioned location of the fan 100 in the helmet body 10 is resulted from the consideration of the typical posture of the user who slightly leans his/her head forward while travels rapidly when participating in rapid leisure sports. Furthermore, the forward leaning angle of the fan 100 relative to the vertical central aids of the helmet body 10 according to the first embodiment of the present invention is determined to maximize the wind contact surface area of the fan 100 while considering both the shape of the parietal region of the user's head and pneumatic effect of rapid air currents flowing around the helmet body 10.

In the first embodiment of the present invention, the forward leaning angle q of the fan 100 is determined to be about 13. To achieve the above-mentioned forward leaning angle q of the fan 100, the rotating shaft 120 of the fan 100 is installed to be inclined forward relative to the vertical central axis of the helmet body 10 by about 13, as best seen in FIG. 2.

The helmet according to the first embodiment ventilates the interior of the helmet with fresh air, thereby giving an agreeable and comfortable fitness to the user. While the user of the helmet travels rapidly when participating in rapid leisure sports, air currents come into contact with the blades 10 of the fan 100 to rotate the fan 100 around the rotating shaft 120. Thus, the fan 100 discharges the air from the interior of the helmet body 10 to the atmosphere through the air ventilating openings 14.

In the above state, flesh atmospheric air is drawn into the interior of the helmet body 10 through the vents 20 provided at the back and both sides of the helmet body 10 and flows to all sections of the user's head through the air channels 21.

Thus, convection is caused in the helmet body 10 to transfer the heat from the user's head to the fresh air, and, thereafter, the heated air with sweat is forcibly discharged to the atmosphere by the rotation of the fan 100. In the above state, sweat and heat are discharged from the interior of the helmet body 10 to the atmosphere along with the air, and thus, any odor is not generated in the helmet. Therefore, the helmet achieves a desired level of ventilation effect to almost completely remove heat and sweat, and thus, odor from the user's head.

FIGS. 3 and 4 are views of a leisure sports helmet according to the second embodiment of the present invention.

In the second embodiment, the fan 100 of the leisure sports helmet is installed in a frontal part of the helmet body 10 to be placed over the frontal region of the user's head, as shown in FIGS. 3 and 4. Since the fan 100 is placed in the frontal part of the helmet body 10, the helmet of the second embodiment has a smart and attractive appearance with a visual decoration effect to arouse the curiosity of the consumers.

Different from the exhaust fan of the helmet according to the first embodiment, the fan 100 according to the second embodiment acts as a suction fan to draw fresh atmospheric air into the interior of the helmet body 10, in place of discharging air from the interior of the helmet body 10 to the atmosphere. To achieve the above-mentioned air drawing function, the blades 110 of the fan 100 according to the second embodiment are curved in directions opposite to those of the blades of the exhaust fan according to the first embodiment.

While a user of the helmet according to the second embodiment travels rapidly when participating in rapid leisure sports, fresh atmospheric air is drawn into the interior of the helmet body 10 by the rotation of the fan 100 and flows to all sections of the user's head though the air channels 21. Thus, convection is caused in the helmet body 10 to transfer the heat from the user's head to the fresh air. Thereafter, the heated air with sweat is discharged to the atmosphere through the vents 20 provided at the back and both sides of the helmet body 10, and thus, any odor is not generated in the helmet.

FIGS. 5 and 6 are views of leisure sports helmets according to the third and fourth embodiments of the present invention, respectively.

In each of the helmets according to the third and fourth embodiments, the fan 100 is constructed to be motor-operated. That is, the helmet according to each of the third and fourth embodiments is provided with a motor 130 to rotate the fan 100. Thus, the fan 100 rotates even when a user of the helmet stops his/her rapid traveling when participating in rapid leisure sports, thus continuously ventilating the interior of the helmet body 10.

The motor-operated mechanism of the fan 100 may be adapted to fans, regardless of the types of the fans. That is, the motor-operated mechanism is freely used with exhaust fans or suction fans. In each of the third and fourth embodiments, the output shaft of the motor 130 is coupled to the boss 110 of the fan 100, while electricity is supplied from a battery 132*a* installed in the battery chamber 132 of the helmet body 10 to the motor 130. Furthermore, a power switch 131 is provided at a predetermined position of the outer casing 12 of the helmet body 10, so that the motor 130 is operated by an ON/OFF operation of the switch 131 to rotate the fan 100.

Of course, it should be understood that the power source to generate power to rotate the fan 100 is not limited to the motor 130, but another type of unit may be used to generate power to rotate the fan 100, without affecting the functioning of the present invention.

In the helmet according to the fourth embodiment of the present invention, a plurality of lamps 140 are installed at predetermined positions of the helmet body 10 to decorate the helmet. In the present invention, a variety of conventional lamps, such as LEDs (light emitting diodes), may be preferably used as the lamps 140.

When a plurality of LEDs are used as the lamps 140, a microcomputer 141 may be provided in the helmet body 10 to turn on or off the lamps 140 through a regular or irregular lighting pattern.

In a further embodiment of the present invention, a light accumulation layer or a recursive reflection layer 143 may be provided on the external surface of at least one of both the fan 100 and the outer shell 12 of the helmet body 10. Particularly when the recursive reflection layer is provided on the external surface of at least one of both the fan 100 and the outer shell 12, the recursive reflection layer recursively reflects light when the light is radiated to the helmet at night, thus making the helmet more active.

In a still another embodiment of the present invention, the helmet may be provided with an audio device in the helmet body 10. The audio device records a variety of sounds, such as voices of people and animals, and outputs the recorded sounds. To achieve the sound recording and outputting function, an audio IC (integrated circuit) 145 may be installed at a predetermined position of the helmet body 10 to act as the audio device. When the helmet having the lamps 140 further includes the audio IC, the helmet outputs sounds from the audio IC and emits light from the lamps 140 while the user of the helmet participates in rapid leisure spots, thus arousing the curiosity of persons around the user.

As described above, the present invention provides a leisure sports helmet having both a fan and a plurality of vents at predetermined positions of a helmet body. The fin may be constructed to rotate by a power generating unit, such as a motor, or air currents. Due to the fan and the vents, the interior of the helmet is forcibly ventilated while a user of the helmet participates in rapid leisure sports. Thus, the helmet achieves a desired level of ventilation effect to almost completely remove any heat and sweat, and thus, odor from the head of the user, and to maintain a pleasant and comfortable atmosphere in the helmet Therefore, the helmet is not injurious to the user.

Furthermore, the fan collaterally provides a decoration effect to make the appearance of the helmet smart and attractive. Furthermore, when the helmet is provided with a plural of lamps, a light accumulation layer, a recursive reflection layer and/or an audio device, the helmet arouses the curiosity of persons, particularly children, around the user of the helmet.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A leisure sports helmet, comprising:

a helmet body comprising:

a rounded outer shell shaped to correspond to a shape of a head of a user and having a strength and rigidity higher than predetermined levels to reduce impacts and disperse a force of the impacts; and an inner shell placed in the outer shell to cover the head of the user and having higher impact absorbing and impact force dispersing abilities;

a plurality of vents formed through both the outer and inner shells at predetermined positions of the helmet body, thus introducing atmospheric air to an interior of the helmet body and discharging the air from the interior of the helmet body to the atmosphere along with heat generated from the head of the user; and a fan provided at a predetermined position of the helmet body to rotate by rapid air currents flowing around the helmet body, thus forcibly discharging the heated air from the interior of the helmet body to the atmosphere through the plurality of vents and decorating the helmet body.

2. The leisure sports helmet according to claim 1, further comprising:

a plurality of air channels provided on an inner surface of the inner shell of the helmet body to distribute the air to all sections of the head of the user.

3. The leisure sports helmet according to claim 1, further comprising:

a depression provided at a predetermined portion of the helmet body, with a shaft hole formed on a center of the depression; and a plurality of ventilating openings provided on the helmet body at positions around the shaft hole of the depression in radial directions, with the fan mounted to the shaft hole of the depression.

4. The leisure sports helmet according to claim 3, wherein the fan comprises:

a boss provided at a center of the fan; and a bearing set in the boss, wherein the boss of the fan is assembled with a rotating shaft of the fan fitted into the shaft hole of the depression of the helmet body, thus the fan rotates in the shaft hole by the air currents flowing around the helmet body.

5. The leisure sports helmet according to claim 1, wherein the fan forcibly rotates by a power generating unit.

6. The leisure sports helmet according to claim 5, wherein the power generating unit comprises a motor, with a power switch provided at a predetermined position of the helmet body to control the motor.

7. The leisure sports helmet according to claim 1, further comprising:

a plurality of lamps provided at predetermined positions of the helmet body to be turned on or off.

8. The leisure sports helmet according to claim 7, wherein the plurality of lamps comprises a plurality of light emitting diodes (LED) which are turned on or off by a microcomputer through a regular or irregular lighting pattern.

9. The leisure sports helmet according to claim 2, wherein the fan is installed in an upper part of the helmet body to be slightly leaned forward, thus being placed over a parietal region of the head of the user, the fan rotating around a rotating shaft thereof, mounted to the helmet body, by the air currents while the user travels rapidly when participating in leisure sports, so that the atmospheric air introduced into the interior of the helmet body through the plurality of vents flows through the plurality of air channels while causing convection to transfer the heat to the air in the interior of the helmet body, and, thereafter, the heated air is forcibly discharged to the atmosphere by the fan, thus ventilating the interior of the helmet body.

10. The leisure sports helmet according to claim 1, wherein the fan is installed in a frontal part of the helmet body to be placed over a frontal region of the head of the user, the fan rotating around a rotating shaft thereof, mounted to the helmet body, by the air currents while the user travels rapidly when participating in leisure sports, so that the fan forcibly introduces the atmospheric air into the interior of the helmet body to cause convection to transfer the heat to the air in the interior of the helmet body, and, thereafter, the heated air is discharged to the atmosphere through the plurality of vents, thus ventilating the interior of the helmet body.

11. The leisure sports helmet according to claim 1, further comprising:

a light accumulation layer or a recursive reflection layer is provided on an eternal surface of the fan or the helmet body.

12. The leisure sports helmet according to claim 1, further comprising:

an audio integrated circuit provided in the helmet body to record sounds and output the recorded sounds.

* * * * *